United States Patent [19]

Buysch et al.

[11] Patent Number: 4,627,929

[45] Date of Patent: Dec. 9, 1986

[54] STABILIZED LUBRICANTS BASED ON POLYETHERS

[75] Inventors: Hans-Josef Buysch, Krefeld; Siegfried Kussi; Günther Boehmke, both of Leverkusen, all of Fed. Rep. of Germany

[73] Assignee: Bayer Aktiengesellschaft, Leverkusen, Fed. Rep. of Germany

[21] Appl. No.: 803,458

[22] Filed: Dec. 2, 1985

[30] Foreign Application Priority Data

Dec. 8, 1984 [DE] Fed. Rep. of Germany ..... 3444884

[51] Int. Cl.[4] ..... C10M 165/18; C10M 119/24

[52] U.S. Cl. ..... 252/47; 252/56 S

[58] Field of Search ..... 252/47, 56 S

[56] References Cited

U.S. PATENT DOCUMENTS

| | | | |
|---|---|---|---|
| 2,848,444 | 8/1958 | Brigmann et al. | 252/47 |
| 2,930,758 | 3/1960 | Tierney et al. | 252/56 S |
| 3,231,499 | 1/1966 | Smith | 252/56 S |
| 3,282,840 | 11/1966 | Foster et al. | 252/56 S |
| 3,696,851 | 10/1972 | Randell | 252/56 S |
| 4,110,234 | 8/1978 | Loveless et al. | 252/47 |
| 4,119,551 | 10/1978 | Yaffe | 252/47 |

FOREIGN PATENT DOCUMENTS

| | | | |
|---|---|---|---|
| 560340 | 7/1958 | Canada | 252/47 |

*Primary Examiner*—William R. Dixon, Jr.
*Assistant Examiner*—Cynthia A. Prezlock
*Attorney, Agent, or Firm*—Sprung Horn Kramer & Woods

[57] ABSTRACT

Stabilized lubricants based on polyethers containing diphenylamine derivatives of the formula

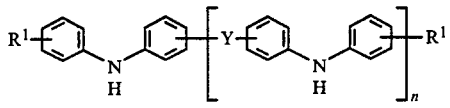

in which $R^1$ denotes hydrogen, a straight-chain or branched $C_4$ to $C_{12}$-alkyl group, a straight-chain or branched $C_4$ to $C_{12}$-alkylene group, a $C_7$ to $C_{12}$-aralkyl group, a $C_7$ to $C_{12}$-aralkylene group, a $C_5$ to $C_{12}$-cycloalkyl group which is optionally substituted by $C_1$ to $C_6$-alkyl, -alkenyl, -cycloalkyl or -cycloalkenyl, or a $C_5$ to $C_{12}$-cycloalkenyl group which is optinally substituted by $C_1$ to $C_6$-alkyl, -alkenyl or -cycloalkenyl, but does not denote a hydrocarbon group derived from a terpene, in the ortho- or para-position relative to the particular N atom, n represents an integer from 1 to 29 and Y represents a bifunctional radical —A— and optionally additionally a bifunctional radical —B—, in each case in the ortho- or para-position relative to the N atoms, wherein —A— denotes a straight-chain or branched $C_4$ to $C_{12}$-alkylene radical, a $C_7$ to $C_{12}$-aralkylene radical, or a $C_5$ to $C_{12}$-cycloalkylene radical which is optionally substituted by $C_1$ to $C_6$-alkyl or -cycloalkyl, but does not denote a hydrocarbon radical derived from a terpene, and —B— denotes —S— or

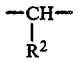

wherein $R^2$ represents hydrogen, $C_1$ to $C_6$-alkyl or $C_5$ to $C_6$-cycloalkyl, and wherein —B— makes up an amount of 0 to 50 mol % of Y, and if appropriate other additives.

10 Claims, No Drawings

STABILIZED LUBRICANTS BASED ON POLYETHERS

The present invention relates to lubricants which are based on polyethers and are stabilized with particular diphenylamine derivatives.

Lubricants based on polyethers are known. They are distinguished by an outstanding lubricating capacity, good viscosity properties, a high flash point, low volatility, a low pour point and little action on metals and sealing materials. They can be employed over a wide temperature range, for example from −20° to +220° C. On the basis of these properties, lubricants based on polyethers are employed, in particular, as hydraulic fluids, brake fluids, metalworking fluids and lubricants for compressors and refrigerating machines and as bearing and gear lubricant oils for units exposed to high thermal and mechanical stresses in the paper, textile and plastics industry.

Lubricants based on polyethers frequently have, however, only an inadequate stability towards heat and oxidation and therefore do not always meet all the requirements imposed on high-grade lubricants.

Additives, such as aromatic amines, for example phenyl-α-naphthylamine, phenothiazine derivatives and certain diphenylamine derivatives, have already been proposed for improving the properties of lubricants based on polyethers (see Ullmanns Encyclopädie der technischen Chemie (Ullmann's Encyclopaedia of Industrial Chemistry), 4th edition, Volume 20, page 510, DE-OS (German Published Specification) No. 2,211,805 and DE-OS (German Published Specification) No. 2,806,133.

The known additives which act as stabilizers do not, however, meet all the requirements in respect of stabilization of lubricants based on polyethers. Thus, in spite of this stabilization, oxidative degradation of the lubricants is seen by the relatively rapid decrease in their viscosity. In addition, when the lubricants thus stabilized are used at higher temperatures for a prolonged period, a considerable loss is observed due to the evaporation of volatile degradation products.

Stabilized lubricants based on polyethers have now been found, which are characterized in that they contain diphenylamine derivatives of the formula

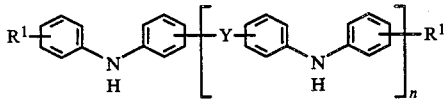

(I)

in which $R^1$ denotes hydrogen, a straight-chain or branched $C_4$ to $C_{12}$-alkyl group, a straight-chain or branched $C_4$ to $C_{12}$-alkylene group, a $C_7$ to $C_{12}$-aralkyl group, a $C_7$ to $C_{12}$-aralkylene group, a $C_5$ to $C_{12}$-cycloalkyl group which is optionally substituted by $C_1$ to $C_6$-alkyl, -alkenyl, -cycloalkyl or -cycloalkenyl, or a $C_5$ to $C_{12}$-cycloalkenyl group which is optionally substituted by $C_1$ to $C_6$-alkyl, -alkenyl or -cycloalkenyl, but does not denote a hydrocarbon group derived from a terpene, in the ortho- or para-position relative to the particular N atom, n represents an integer from 1 to 29 and Y represents a bifunctional radical —A— and optionally additionally a bifunctional radical —B—, in each case in the ortho- or para-position relative to the N atoms, wherein —A— denotes a straight-chain or branched $C_4$ to $C_{12}$-alkylene radical, a $C_7$ to $C_{12}$-aralkylene radical, or a $C_5$ to $C_{12}$-cycloalkylene radical which is optionally substituted by $C_1$ to $C_6$-alkyl or -cycloalkyl, but does not denote a hydrocarbon radical derived from a terpene, and —B— denotes —S— or

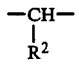

wherein $R^2$ represents hydrogen, $C_1$ to $C_6$-alkyl or $C_5$ to $C_6$-cycloalkyl, and wherein —B— makes up an amount of 0 to 50 mol % of Y.

In formula (I), $R^1$ preferably represents hydrogen, benzyl, styryl, α-methylstyrl, tert.-butyl, tert.-amyl, isononyl, cyclohexyl, isooctyl, methylcyclohexyl or one of the radicals

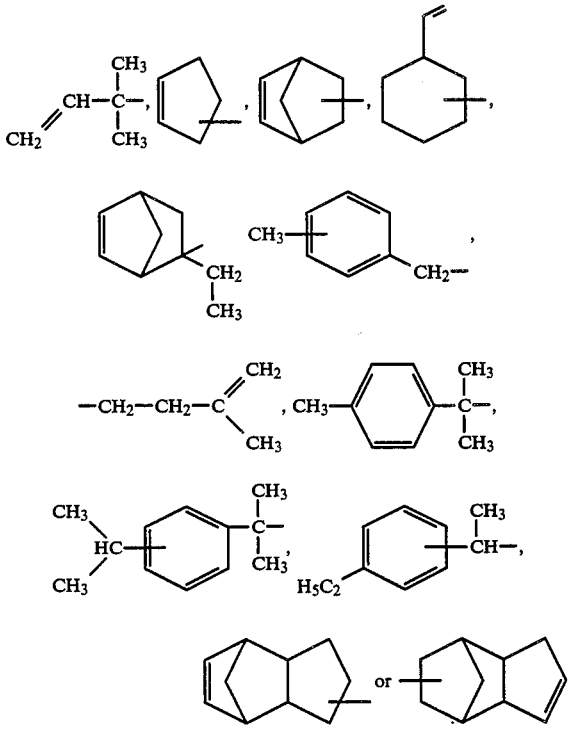

in each case in the ortho- or para-position relative to the particular N atom, particularly preferably hydrogen,

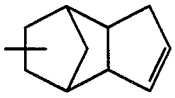

or α-methylstyryl, in each case in the ortho- or para-position relative to the particular N atom, and especially preferably hydrogen, n preferably represents an integer from 1 to 19, and particularly preferably an integer from 1 to 12, Y in the meaing of —A— preferably represents

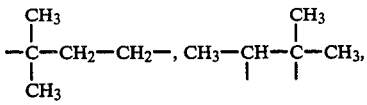

-continued

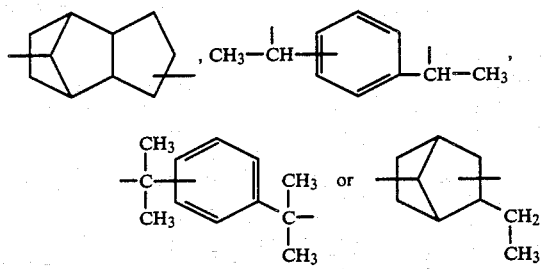

and in the meaning of —B— preferably represents —$CH_2$—.

The content of —B— in Y is preferably 0 to 40 mol %. Particularly preferably, Y represents only —A— in the meaning of

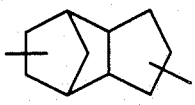

The lubricants which are based on polyethers and are stabilized according to the invention can contain diphenylamine derivatives of the formula (I) in amounts of, for example, 0.1 to 10% by weight, based on the mixture. This amount is preferably 0.2 to 5% by weight.

Diphenylamine derivatives of the formula (I) are known per se. They can be prepared, for example, by a process in which diphenylamine and/or diphenylamine derivatives of the formula (II)

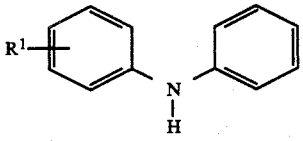

(II)

in which $R^1$ has the meaning given in the case of formula (I), are reacted in the presence of a strong acid ($pK_a$ value of less than 2) at 50 to 300° C. with bifunctional compounds of the formulae (III) to (V)

Hal-Y-Hal (III)

HO-Y-OH (IV)

HCOO-Y-OOCH (V)

in which Y has the meaning given in the case of formula (I) and Hal represents a halogen atom or with olefines derived from the compounds of the formulae (III) to (V) by splitting off HHal, $H_2O$ or HCOOH.

Lubricants based on polyethers are also known per se (see, for example, R. C. Gunderson and A. W. Hardt "Synthetic Lubricants", Reinhold Publishing Corp. New York, 1962, pages 61 et seq.). In general, they contain polymers of epoxides of the formula (VI)

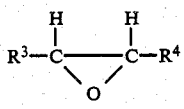

(VI)

in which $R^3$ and $R^4$ can be identical or different and represent hydrogen or $C_1$ to $C_{12}$-alkyl, and/or polymers of tetrahydrofuran and/or block polymers and/or random polymers of various epoxides of the formula (VI) and/or tetrahydrofuran. The lubricants based on polyethers preferably contain homopolymers and/or copolymers of ethylene oxide and propylene oxide.

Such polyethers are in general oils which have molecular weights of, for example, 500 to 20,000. They preferably have molecular weights of 1,000 to 7,000. They can be prepared by methods which are known per se, for example by alkali-catalysed or acid-catalysed polymerization of the cyclic ethers, it being possible to use monoalcohols, polyalcohols or amines as starter molecules. The OH end groups of the polyethers thus prepared can be blocked, that is to say converted into ether or ester end groups, by customary alkylation or acylation.

Polyethers which are particularly suitable for the stabilization according to the invention are oils with molecular weights of 500 to 20,000, preferably with molecular weights of 1,500 to 7,000, which have been prepared by alkali-catalyzed addition of propylene oxide and, if appropriate, ethylene oxide onto alcohols, for example onto ethanol, butanol, propanediol, glycerol, trimethylolpropane or pentaerythritol. Other polyethers which are particularly suitable for the stabilization according to the invention are oils with molecular weights of 500 to 10,000, preferably of 1,000 to 7,000, which have been prepared by acid-catalyzed copolymerization of at least two substances from the group comprising ethylene oxide, propylene oxide, tetrahydrofuran and epoxides with 6 to 20, preferably 8 to 12, C atoms.

The polyethers stabilized according to the invention with diphenylamine derivatives of the formula (I) can additionally contain other constituents, for example (a) Diphenylamine derivatives of the formula (VII)

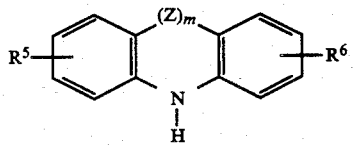

(VII)

in which $R^5$ and $R^6$ can be identical or different and represent hydrogen, $C_1$ to $C_{12}$-alkyl or $C_7$ to $C_{12}$-alkaryl, preferably isooctyl and/or styryl, Z represents sulphur and m represents 0 or 1, (b) metal deactivators of the salicylideneamine type of the formula (VIII)

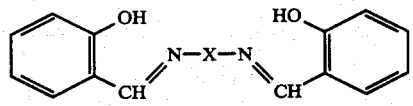

(VIII)

in which X represents a two-bonds, optionally nitrogen-containing aliphatic radical, preferably $-(CH_2)_2-$, $-\underset{\underset{CH_3}{|}}{CH}-CH_2-$, $-(CH_2)_3-$, $-(CH_2)_2-\underset{\underset{CH_3}{|}}{N}-(CH_2)_2-$ or $(CH_2-CH_2-NH)_m-CH_2-CH_2$, where m=0 to 5, preferably where m=1, (c) Other stabilizers based on aromatic amines, such as phenyl-α-naphthylamine, 4-isopropylaminodiphenylamine, N,N'-dicyclohexyl-p-phenylenediamine and/or 4-isohexyl-amino-diphenylamine, (d) Phenolic antioxidants, such as 2,6-di-tert.-butyl-p-cresol, 2,6-di-tert.-butyl-4-methoxypehnol, methyl- and butyl-hydroquinone, 2,2'-methylene-bis-(6-tert.-butyl-4-methylphenol), 2,2'-methylene-bis-(6-cyclohexyl-4-methylphenol), 1,1'-bis-(2-hydroxy-3,5-dimethylphenyl)-butane, 2,2'-thio-bis-(4-methyl-6-tert.-butylphenol) and 4,4'-methylene-bis-(2,6-ditert.-butylphenol), and (e) Other customary additives, such as corrosion inhibitors, for example succinic acid half-esters, phosphorous acid esters and phosphoric acid esters, and anti-wear agents, for example nitrogen and/or phosphorus compounds, such as triaryl phosphates and mono- and di-arylphosphonates.

The diphenylamine derivatives of the formula (VII) can be present, for example, in amounts of 0 to 10% by weight, based on the mixture. This amount is preferably 0.1 to 5% by weight.

The metal deactivators of the formula (VIII) can be present, for example, in an amount of 0 to 4% by weight, based on the mixture. This amount is preferably 0.5 to 2% by weight.

The other additives can in each case be present, for example, in amounts of 0 to 10% by weight, based on the mixture. This amount is preferably 0 to 5% by weight.

Stabilized lubricants based on polyethers, which simultaneously contain diphenylamine derivatives of the formula (I), diphenylamine derivatives of the formula (VII) and metal deactivators of the formula (VIII) are of particular interest, since these give a synergistic mixture, that is to say a mixture which is better stabilized than can be expected from the individual actions of the additives.

The lubricants according to the invention can be prepared in various ways. For example, diphenylamine derivatives of the formula (I) and, if appropriate, other additives can be added in the desired proportions to polyethers and, if appropriate, dissolved therein by heating, for example to 80° to 100° C. Another possibility comprises first preparing concentrates of the stabilizers with a suitable medium and adding these, according to the desired proportions, to the polyether lubricant to be stabilized. Suitable concentrations for such concentrates are, for example, from 20 to 90% by weight, and suitable media for their preparation are, for example, higher alcohols, such as 2-ethylhexanol and octaethylene glycol, and especially polyether lubricants. It is also possible first to mix the stabilizers or their concentrates in the desired proportions and to add this mixture to the lubricant to be stabilized.

The drop in viscosity and the losses by evaporation of volatile degradation products is substantially lower with the lubricants which are based on polyethers and are stabilized according to the invention with diphenylamine derivatives of the formula (I) than with lubricants which are based on polyethers and have been stabilized with customary additives.

The following examples illustrate the present invention without limiting it.

EXAMPLES

EXAMPLE 1

In each case 2%, by weight based on the mixture, of the particular stabilizers mentioned were added to a commercially available polypropylene ether started on trimethylolpropane and with a molecular weight of 5,500, and the mixture was tested in accordance with DIN 51 352 part 2 for its stability towards oxidation.

The oil to be tested was aged in a glass vessel with 0.1% by weight of iron-III oxide as a catalyst at 200° C. for 24 hours, while passing in 15 l/hour of air. The viscosity of the aged samples at 40° C. was determined and was compared with the viscosity of the non-aged sample.

The stability of the mixture is greater the closer the quotient final viscosity/initial viscosity is to 1.

Table 1 shows the stabilizers tested and Table 2 shows the results obtained. The measurement of the (kinematic) viscosity was carried out in accordance with DIN 51562 part 1 (Ubbelohde-method).

TABLE 1

| Stabilizer No. | Composition | Comments |
|---|---|---|
| 1 | Formula (I); $R^1$ = H, Y = 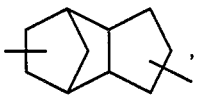 , n = 1 to 5 | according to the invention |
| 2 | Formula (I); $R^1$ = 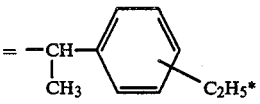 Y = 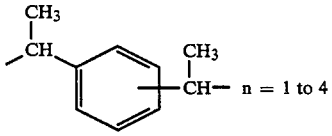 n = 1 to 4 | according to the invention |

TABLE 1-continued

| Stabilizer No. | Composition | Comments |
|---|---|---|
| 3 | Formula (I); $R^1$ = H, Y = $-C(CH_3)_2-$ 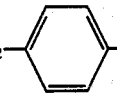 $-C(CH_3)_2-$, n = 1 to 2 | according to the invention |
| 4 | Formula (VII); $R^5$ and $R^6$ = 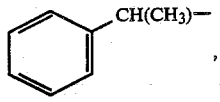 $CH(CH_3)-$, m = o, | known (see DE-OS (German Published Specification) 2,806,133) |
| 5 | Formula (VII); $R^5$ and $R^6$ = 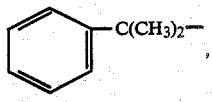 $-C(CH_3)_2-$, Z = sulphur, m = 1 | known (see DE-OS (German Published Specification) 2,211,805) |
| 6 | 2,6-Di-tert.-butyl-p-cresol | known (see (DE-OS (German Published Specification) 2,806,133) |
| 7 | Formula (VIII); X = $-(CH_2)_2-NH-(CH_2)_2-$ | known (see Ullmann, Volume 20, page 543) |
| 8 | Formula (VII); $R^5$ and $R^6$ = 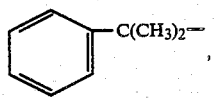 $-C(CH_3)_2-$, m = o, | known (see U.S. Pat. No. 3,751,472) |
| 9 | Formula (VIII); X = $-CH_2-CH_2-$ | known (see Ullmann, Volume 20, page 543) |
| 10 | 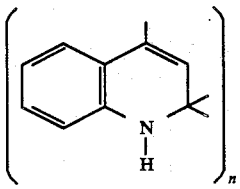 n = 2 to 3 | known (see Ullmann, Volume 20, page 510) |

*Mixture of 60% of meta-$C_2H_5$ and 40% of ortho-$C_2H_5$

TABLE 2

| Stabilizer No. | Viscosity at 40° $mm^2/s$ before ageing | after ageing | Quotient | Comments |
|---|---|---|---|---|
| 1 | 243 | 233 | 0.96 | according to the invention |
| 2 | 243 | 204 | 0.84 | |
| 3 | 251 | 237 | 0.94 | |
| 4 | 225 | 127 | 0.57 | for comparison |
| 5 | 238 | 120 | 0.50 | |
| 8 | 231 | 104 | 0.45 | |
| 10 | 249 | 179 | 0.72 | |

The quotient close to 1 in experiments 1-3 shows the superior action of the stabilization according to the invention in contrast to the comparison experiments according to the prior art

TABLE 3

| Stabilizer No. | Amount | Viscosity 40° mm/s before ageing | after ageing | Quotient | Comments |
|---|---|---|---|---|---|
| 4 | 2% by weight | 225 | 127 | 0.57 | comparison |
| 4 | 1.4% by weight | 221 | 146 | 0.66 | comparison |
| 6 | 0.6% by weight | | | | |
| 4 | 1.2% by weight | 221 | 149 | 0.67 | comparison |
| 6 | 0.6% by weight | | | | |
| 8 | 0.2% by weight | | | | |
| 4 | 1.2% by weight | 221 | 150 | 0.68 | comparison |
| 6 | 0.6% by weight | | | | |
| 7 | 0.2% by weight | | | | |
| 4 | 1.2% by weight | 226 | 169 | 0.74 | according to the invention |
| 1 | 0.6% by weight | | | | |
| 8 | 0.2% by weight | | | | |
| 4 | 1.2% by weight | 225 | 221 | 0.98 | according to the invention |
| 1 | 0.6% by weight | | | | |
| 7 | 0.2% by weight | | | | |

EXAMPLE 2

Various mixtures of the stabilizers listed in Table 1 were added to the polyether used in Example 1, and in particular such that the polyether content in the lubricant formulation was always 98% by weight. The nature and content of the stabilizers and the viscosity before and after ageing (measured in accordance with DIN 51 352, part 2) of the lubricant formulation are shown in Table 3.

It can be clearly seen from Table 3 that stabilizer 4 by itself has a weaker action than stabilizers 4+6. The addition of stabilizer 7 or stabilizer 8 produces only an insignificant improvement. A considerable jump towards a higher action is achieved by using stabilizer 1 (according to the invention) instead of stabilizer 6. This particularly applies to the combination of stabilizers 4, 1 and 7. This stabilizer mixture accordingly forms a synergistic mixture.

EXAMPLE 3

In this example, various lubricant oil formulations based on polyethers were compared in respect of their stability towards thermooxidation. The evaporation losses which occur in a stream of hot air at a particular temperature were measured.

For this, a quartz crucible was filled with 3 $cm^3$ of the sample, a liquid surface of 3.7 $cm^2$ being formed. The crucible containing the sample was then kept in a heating oven, through which flowed air heated exactly to the testing temperature. The weight loss of the sample was determined gravimetrically as a function of the time (see Table 4, data in % by weight).

The lower the evaporation losses at a particular temperature as a function of the time, the better is the stability of the lubricant oil formulation.

Table 4 shows a good resistance to degradation for all the products at the lower temperatures and short exposure times. At higher temperatures, and above all with long exposure times, the formulations according to the invention prove to be clearly more stable. The little or even constant evaporation loss of samples A and B over a period of 3 hours at increasing temperatures is also remarkable.

In spite of this considerably improved action of the polyethers stabilized according to the invention, the amount of stabilizer used is significantly lower than in comparison experiment C.

TABLE 4

| | Evaporation losses | | | | | | | | | | |
|---|---|---|---|---|---|---|---|---|---|---|---|
| | 235° C. | | | | 244° C. | | | 250° C. | 260° C. | 270° C. | |
| Lubricant | 3 h | 8 h | 16 h | 24 h | 8 h | 16 h | 24 h | 3 h | 3 h | 3 h | Remarks |
| A | 1.9 | 4.7 | 43 | — | 15.5 | 63 | 77 | 6.7 | 9.3 | 13.3 | according to the invention |
| B | 2.0 | 4.5 | 44 | 64 | 16.1 | 63 | 79 | 10.6 | 10.4 | 10.4 | according to the invention |
| C | 2.5 | 4.0 | 43 | 78 | 7.5 | 79 | 90 | 4.1 | — | 16.9 | comparison |
| D | 3.1 | 7.9 | 80 | 100 | 23 | 92 | 100 | 5.6 | 62 | 79 | comparison |

Explanations for Table 4

A = 94% by weight of polyether based on propylene oxide (molecular weight: 4,500), 2% by weight of diphenyl cresyl phosphate, 2.4% by weight of stabilizer No. 4 (see Example 1), 1.2% by weight of stabilizer No. 1 (see Example 1) and 0.4% by weight of stabilizer No. 7 (see Example 1)

B = 94% by weight of polyether based on propylene oxide (molecular weight: 4,000) and stabilizer as in A.

C = 93% by weight of polyether based on propylene oxide (molecular weight: 5,000) and 7% by weight of a commercially available stabilizer formulation (LP 1655 from Hoechst AG) according to the prior art.

D = 100% by weight of a commercially available lubricant oil formulation (Glygole 30) which is based on polyether and has been introduced as a lubricating oil which is stable towards high temperatures.

Explanations for Table 4 A=94% by weight of polyether based on propylene oxide (molecular weight: 4,500), 2% by weight of diphenyl cresyl phosphate, 2.4% by weight of stabilizer No. 4 (see Example 1), 1.2% by weight of stabilizer No. 1 (see Example 1) and 0.4% by weight of stabilizer No. 7 (see Example 1) B=94% by weight of polyether based on propylene oxide (molecular weight: 4,000) and stabilizer as in A. C=93% by weight of polyether based on propylene oxide (molecular weight: 5,000) and 7% by weight of a commercially available stabilizer formulation (LP 1655 from Hoechst AG) according to the prior art. D=100% by weight of a commercially available lubricant oil formulation (Glygole 30) which is based on polyether and has been introduced as a lubricating oil which is stable towards high temperatures.

What is claimed is:

1. A stabilized lubricant composition comprising a polyether lubricant, and an effective stabilizing amount of a diphenylamine derivative of the formula

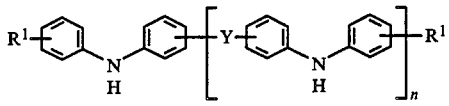

in which $R^1$ denotes hydrogen, a straight-chain or branched $C_4$ to $C_{12}$-alkyl group, a straight-chain or branched $C_4$ to $C_{12}$-alkylene group, a $C_7$ to $C_{12}$-aralkyl group, a $C_7$ to $C_{12}$-aralkylene group, a $C_5$ to $C_{12}$-cycloalkyl group which is optionally substituted by $C_1$ to $C_6$-alkyl, -alkenyl, -cycloalkyl or -cycloalkenyl, or a $C_5$ to $C_{12}$-cycloalkenyl group which is optionally substituted by $C_1$ to $C_6$-alkyl, -alkenyl or -cycloalkenyl, but does not denote a hydrocarbon group derived from a terpene, in the ortho- or para-position relative to the particular N atom, n represents an integer from 1 to 29 and Y represents a bifunctional radical —A— and optionally additionally a bifunctional radical —B—, in each case in the ortho- or para-position relative to the N atoms, wherein —A— denotes a straight-chain or branched $C_4$ to $C_{12}$-alkylene radical, a $C_7$ to $C_{12}$-aralkylene radical, or a $C_5$ to $C_{12}$-cycloalkylene radical which is optionally substituted by $C_1$ to $C_6$-alkyl or -cycloalkyl, but does not denote a hydrocarbon radical derived from a terpene, and —B— denotes —S— or

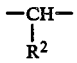

wherein $R^2$ represents hydrogen, $C_1$ to $C_6$-alkyl or $C_5$ to $C_6$-cycloalkyl and wherein —B— makes up an amount of 0 to 50 mol% of Y.

2. A stabilized lubricant composition according to claim 1, wherein $R^1$ represents hydrogen, benzyl, styryl, α-methylstyryl, tert.-butyl, tert.-amyl, isononyl, cyclohexyl, isooctyl, methylcyclohexyl or one of the radicals

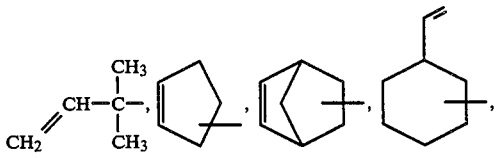

-continued

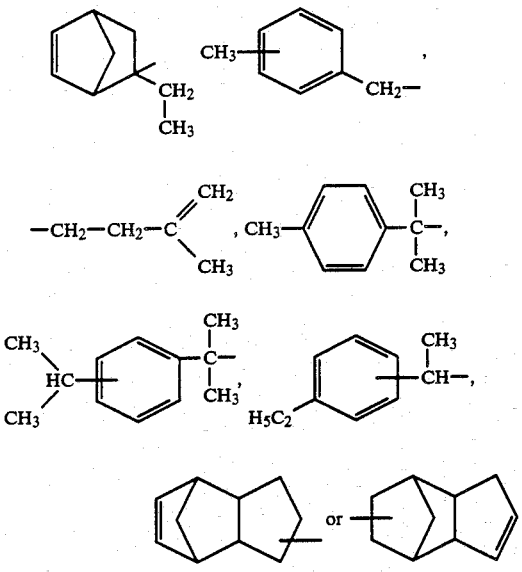

in each case in the ortho- or para-position to the particular N atom, n represents an integer from 1 to 19 and Y in the meaning of —A— represents

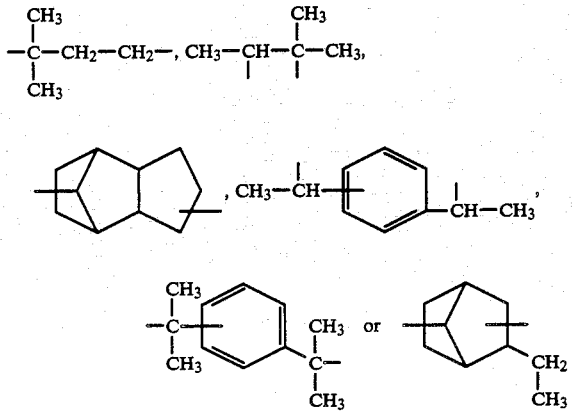

and in the meaning of —B— represents $—CH_2—$.

3. A stabilized lubricant composition according to claim 1, wherein said composition contains 0.1 to 10% by weight of the diphenylamine derivative based on the mixture.

4. A stabilized lubricant composition according to claim 1, wherein said polyester is a polymer of an epoxide of the formula

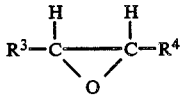

in which $R^3$ and $R^4$ can be identical or different and represent hydrogen or $C_1$ to $C_{12}$-alkyl, and/or a polymer of tetrahydrofuran and/or a block polymer and/or a random polymer of various expoxides of the formula

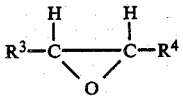

and/or tetrahydrofuran wherein $R^3$ and $R^4$ are as defined above.

5. A stabilized lubricant composition according to claim 1 wherein said polyether is in the form of an oil with molecular weight of 500 to 20,000.

6. A stabilized lubricant composition according to claim 1, which additionally contains a diphenylamine derivative of the formula

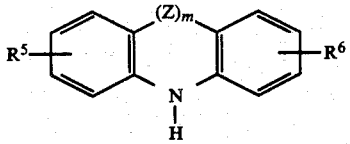

$R^5$ and $R^6$ can be identical or different and represent hydrogen, $C_1$ to $C_{12}$-alkyl or $C_7$ to $C_{12}$-alkaryl, Z represents sulphur and m represents 0 or 1 and a metal deactivator of the salicylideneamine type of the formula

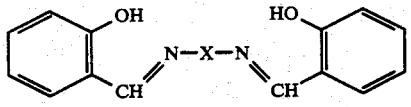

in which X represents an aliphatic radical which is optionally nitrogen-containing.

7. A stabilized lubricant composition according to claim 6, wherein said additional diphenylamine derivative is present in an amount of 0.1 to 5% by weight and the metal deactivator in an amount of 0.5 to 2% by weight, in each case based on the mixture.

8. A stabilized lubricant composition according to claim 1 which additionally contains other constituents selected from known aromatic amine stabilizers, phenolic antioxidants, corrosion inhibitors and/or antiwear agents.

9. A stabilized lubricants composition according to claim 8, wherein said other stabilizers are present in each case in amounts of up to 10% by weight, based on the mixture.

10. A process for the preparation of a stabilized lubricant composition, wherein an effective stabilizing amount of a diphenylamine derivative of the formula

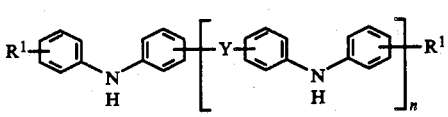

(I)

in which $R^1$ denotes hydrogen, a straight-chain or branched $C_4$ to $C_{12}$-alkyl group, a straight-chain or branched $C_4$ to $C_{12}$-alkylene group, a $C_7$ to $C_{12}$-aralkyl group, a $C_7$ to $C_{12}$-aralkylene group, a $C_5$ to $C_{12}$-cycloalkyl group which is optionally substituted by $C_1$ to $C_6$-alkyl, -alkenyl, -cycloalkyl or -cycloalkenyl, or a $C_5$ to $C_{12}$-cycloalkenyl group which is optionally substituted by $C_1$ to $C_6$-alkyl, -alkenyl or -cycloalkenyl, but does not denote a hydrocarbon group derived from a terpene, in the ortho- or para-position relative to the particular N atom, n represents an integer from 1 to 29 and Y represents a bifunctional radical —A— and optionally additionally a bifunctional radical —B—, in each case in the ortho- or para-position relative to the N atoms, wherein —A— denotes a straight-chain or branched $C_4$ to $C_{12}$-alkylene radical, a $C_7$ to $C_{12}$-aralkylene radical, or a $C_5$ to $C_{12}$-cycloalkylene radical which is optionally substituted by $C_1$ to $C_6$-alkyl or -cycloalkyl, but does not denote a hydrocarbon radical derived from a terpene, and —B— denotes —S— or $$-\underset{\underset{R^2}{|}}{CH}-$$

wherein $R^2$ represents hydrogen, $C_1$ to $C_6$-alkyl or $C_5$ to $C_6$-cycloalkyl, and wherein —B— makes up an amount of 0 to 50 mol % of Y, is added to a polyether and is dissolved therein, with heating.

* * * * *